US005839515A

United States Patent [19]

Yuan et al.

[11] Patent Number: 5,839,515

[45] Date of Patent: Nov. 24, 1998

[54] SLIP RETAINING SYSTEM FOR DOWNHOLE TOOLS

[75] Inventors: Yusheng Yuan, Houston; Douglas W. Davison, Pearland, both of Tex.; Kevin T. Berscheidt, Duncan, Okla.

[73] Assignee: Halliburton Energy Services, Inc., Duncan, Okla.

[21] Appl. No.: 888,719

[22] Filed: Jul. 7, 1997

[51] Int. Cl.[6] ..... E21B 33/129

[52] U.S. Cl. ..... 166/387; 166/118; 166/134

[58] Field of Search ..... 166/376, 387, 166/118, 135, 134, 138, 179, 382

[56] References Cited

U.S. PATENT DOCUMENTS

| | | | |
|---|---|---|---|
| 2,942,665 | 6/1960 | Davis | 166/137 |
| 4,349,071 | 9/1982 | Fish | 166/124 |
| 4,730,670 | 3/1988 | Kim | 166/134 |
| 5,224,540 | 7/1993 | Streich et al. | 166/118 |
| 5,271,468 | 12/1993 | Streich et al. | 166/387 |
| 5,390,737 | 2/1995 | Jacobi et al. | 166/184 |
| 5,540,279 | 7/1996 | Branch et al. | 166/118 |
| 5,701,959 | 12/1997 | Hushbeck et al. | 166/387 |

OTHER PUBLICATIONS

Halliburton Services—Sales and Service Catalog No. 43, pp. 2561–2562 and pp. 2556–2557.

*Primary Examiner*—Frank Tsay
*Attorney, Agent, or Firm*—Stephen R. Christian

[57] ABSTRACT

Method and apparatus particularly suitable for tools having a center mandrel, a plurality of slip segments disposed in an initial position around the mandrel and requiring a retaining means for holding the slip segments in an initial position prior to setting the tool downhole. The subject retaining system is characterized by at least one frangible retaining band extending at least partially around the slips and at least one elastic O-ring extending at least partially around the slips. Preferably the retaining band is non-metallic and both the retaining band and the elastic O-ring reside in a common groove formed in the outer face of each slip. The groove further preferably has an L-shape due to an under cut in the groove to form a lip extending over the retaining band. Hardened inserts may be molded into the slips. The inserts may be metallic, such as hardened steel, or non-metallic, such as a ceramic material.

20 Claims, 3 Drawing Sheets

SLIP RETAINING SYSTEM FOR DOWNHOLE TOOLS

CROSS REFERENCE TO RELATED APPLICATIONS

Not Applicable

FEDERALLY SPONSORED RESEARCH OR DEVELOPMENT

Not Applicable

MICROFICHE APPENDIX

Not Applicable

BACKGROUND OF THE INVENTION

This invention relates generally to downhole tools for use in oil and gas wellbores and methods of drilling such apparatus out of wellbores, and more particularly, to such tools having drillable components made from metallic or nonmetallic materials, such as soft steel, cast iron, engineering grade plastics and composite materials. This invention relates particularly to improvements in the initial retention of slip-elements commonly used in the setting or anchoring of downhole drillable packer and bridge plug tools in wellbores.

In the drilling or reworking of oil wells, a great variety of downhole tools are used. For example, but not by way of imitation, it is often desirable to seal tubing or other pipe in the casing of the well, such as when it is desired to pump cement or other slurry down the tubing and force the slurry out into a formation. It thus becomes necessary to seal the tubing with respect to the well casing and to prevent the fluid pressure of the slurry from lifting the tubing out of the well. Downhole tools referred to as packers and bridge plugs are designed for these general purposes and are well known in the art of producing oil and gas.

The EZ Drill SV® squeeze packer, for example, includes a set ring housing, upper slip wedge, lower slip wedge, and lower slip support made of soft cast iron. These components are mounted on a mandrel made of medium hardness cast iron. The EZ Drill® squeeze packer is similarly constructed. The Halliburton EZ Drill® bridge plug is also similar, except that it does not provide for fluid flow therethrough.

All of the above-mentioned packers are disclosed in Halliburton Services—Sales and Service Catalog No. 43, pages 2561–2562, and the bridge plug is disclosed in the same catalog on pages 2556–2557.

The EZ Drill® packer and bridge plug and the EZ Drill SV® packer are designed for fast removal from the well bore by either rotary or cable tool drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and bridge plugs mentioned above are designed to withstand pressures of about 10,000 psi (700 Kg/cm$^2$) and temperatures of about 425° F. (220° C.) after being set in the well bore. Such pressures and temperatures require using the cast iron components previously discussed.

In order to overcome the above long standing problems, the assignee of the present invention introduced to the industry a line of drillable packers and bridge plugs currently marketed by the assignee under the trademark FAS DRILL. The FAS DRILL line of tools consist of a majority of the components being made of non-metallic engineering grade plastics to greatly improve the drillability of such downhole tools. The FAS DRILL line of tools have been very successful and a number of U.S. patents have been issued to the assignee of the present invention, including U.S. Pat. No. 5,271,468 to Streich et al., U.S. Pat. No. 5,224,540 to Streich et al., U.S. Pat. No. 5,390,737 to Jacobi et al., and U.S. Pat. No. 5,540,279 to Branch et al. The preceding patents are specifically incorporated herein.

The tools described in all of the above references typically make use of metallic or non-metallic slip-elements, or slips, that are initially retained in close proximity to the mandrel but are forced outwardly away from the mandrel of the tool to engage a casing previously installed within the wellbore in which operations are to be conducted upon the tool being set. Thus, upon the tool being positioned at the desired depth, the slips are forced outwardly against the wellbore to secure the packer, or bridge plug as the case may be, so that the tool will not move relative to the casing when for example operations are being conducted for tests, to stimulate production of the well, or to plug all or a portion of the well.

It is common practice to initially restrain the slips about the mandrel with a frangible restraining member such as a steel wire usually in the case of essentially metallic tools, and a non-metallic band in the case of essentially non-metallic tools, so that the downhole tool could be transported, handled, and placed in the wellbore without the slips becoming disassociated from the tool or extending outwardly from the tool prematurely. After the tool has positioned at the desired location within the wellbore, the tool is set by a setting tool or other means that loads the tool in such a way that the slips are forced outwardly and the retaining means is broken allowing the slips to properly position themselves between the wellbore and the tool.

In the smaller sizes of the subject packers and bridge plugs, such a prior art non-metallic retaining band has not generated many if any problems. However, in the larger sizes, those exceeding approximately 7 inches (178 mm) in nominal diameter, occasional problems have been encountered during the setting of the tool with composite retaining bands breaking and pieces thereof becoming lodged between the outer face of the slips and the wellbore. The pieces of retaining band being lodged between the slips and the wellbore can then prevent one or more of the slips from effectively engaging the wellbore and properly anchoring the tool within the wellbore. Such non-effective engagement can significantly lower the ability of the tool to resist slipping longitudinally along the wellbore when the tool is subjected to fluid pressures and thereby jeopardize the success of the planned treatment or plugging of the well.

There is also a need of an improved slip retaining means, especially in the case of non-metallic downhole packers and bridge plug type tools for the slip retaining means to be easily drillable, inexpensive, and strong enough to withstand surface handling, traveling downhole, and fluid flow around the tool within the wellbore prior to the actual setting of the tool. Furthermore, the retaining means needs to consistently and reliably release the slips at a preselected load which serves to set the tool in the wellbore. If the slip-retaining means does not release the slips at a preselected load, it may not be possible to set the tool with certain setting tools that may be available at a given well.

Thus, there remains a need within art for a reliable and consistent means for retaining the slips in their initial positions yet when the tool is sufficiently loaded, will allow the slips to properly reposition themselves upon setting the tool in the wellbore.

Another object of the present invention, especially when using two or more retaining members about a group of slips, is to provide a design that allows the two members to break at approximately the same preselected tool setting load that causes the slips to be forced outward away from the tool. Typically, a 1000 pound force, or load, is selected as the force that the packing tool must be subjected to set the tool. Upon the tool being subject to the predetermined set load, the slips will cause the retaining member closest to the packer member to break and the slips will begin to pivot outwardly because the further most retaining members from the packing assembly will not yet be subjected to the requisite tensile forces causing it to break due to the design and coaction of the slips and the slip wedge. For example, when using non-metallic slips and non-metallic slip wedges as discussed in U.S. Pat. No. 5,540,279, the inside faces of the slips and outside face of the wedge have bearing surfaces that slide against each other at an angle with respect to the centerline of the tool. Thus, as the slips move outward the retaining member may not be subjected to the requisite tensile forces needed to break the member notwithstanding that the tool itself remains subjected to the predetermined setting load.

BRIEF SUMMARY OF THE INVENTION

The slip retaining system of the present invention is a method and apparatus particularly suitable for tools having a center mandrel, a plurality of slip segments disposed in an initial position around the mandrel and requiring a retaining means for holding the slip segments in an initial position prior to setting the tool downhole. The subject retaining system is characterized by at least one frangible retaining band extending at least partially around the slips and at least one elastic O-ring extending at least partially around the slips. Preferably the retaining band is non-metallic and both the retaining band and the elastic O-ring reside in a common groove formed in the outer face of each slip. The groove further preferably has an L-shape due to an under cut in the groove to form a lip extending over the retaining band. Hardened inserts may be molded into the slips. The inserts may be metallic, such as hardened steel, or nonmetallic, such as a ceramic material.

An alternative embodiment of a rectangular shaped groove having a elastic member installed over a frangible retaining member is also disclosed.

Additional objects and advantages of the invention will become apparent as the following detailed description of the preferred embodiments is read in conjunction with the drawings which illustrate the preferred embodiment of the present invention.

DETAILED DESCRIPTION OF THE INVENTION

Figure 1:
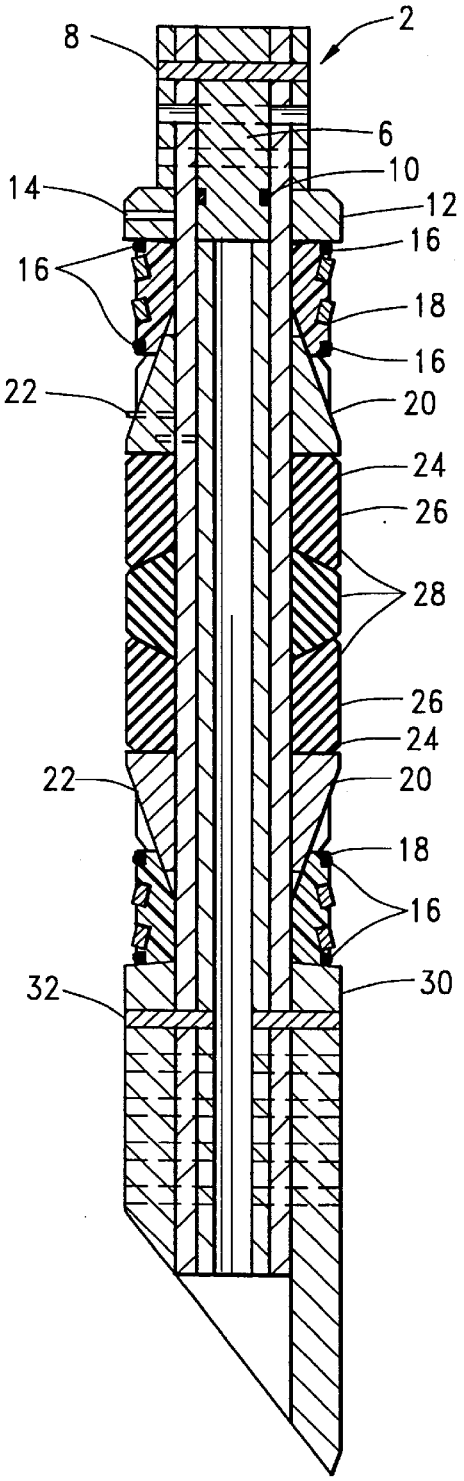
FIG. 1 PRIOR ART
FIG. 1 is a cross-sectional view of representative prior art downhole packer apparatus depicting prior art slip assemblies and slip retaining elements.

Referring now to the drawings, FIGS. 1–3 are of prior art and have been provided as a convenient background reference. The slip retention system of the present invention is quite suitable for use with the slip segments in the representative prior art tool shown in FIGS. 1–3. Therefore a description of the workings of the prior art tool and associated slips will be followed by the description of the present invention as the present invention is very adaptable to the particular prior art slips shown in FIGS. 1–3 as well as other slips not shown.

FIG. 1 is a prior art representation of a downhole tool 2 having a mandrel 4. The particular tool of FIG. 1 is referred to as a bridge plug due to the tool having a plug 6 being pinned within mandrel 4 by radially oriented pins 8. Plug 6 has a seal means 10 located between plug 6 and the internal diameter of mandrel 4 to prevent fluid flow therebetween. The overall tool structure, however, is quite adaptable to tools referred to as packers, which typically have at least one means for allowing fluid communication through the tool. Packers may therefore allow for the controlling of fluid passage through the tool by way of a one or more valve mechanisms which may be integral to the packer body or which may be externally attached to the packer body. Such valve mechanisms are not shown in the drawings of the present document. The representative tool may be deployed in wellbores having casings or other such annular structure or geometry in which the tool may be set.

Packer tool 2 includes the usage of a spacer ring 12 which is preferably secured to mandrel 4 by pins 14. Spacer ring 12 provides an abutment which serves to axially retain slip segments 18 which are positioned circumferentially about mandrel 4. Slip retaining bands 16 serve to radially retain slips 18 in an initial circumferential position about mandrel 4 as well as slip wedge 20. Bands 16 are made of a steel wire, a plastic material, or a composite material having the requisite characteristics of having sufficient strength to hold the slips in place prior to actually setting the tool and to be easily drillable when the tool is to be removed from the wellbore. Preferably bands 16 are inexpensive and easily installed about slip segments 18. Slip wedge 20 is initially positioned in a slidable relationship to, and partially underneath slip segments 18 as shown in FIG. 1. Slip wedge 20 is shown pinned into place by pins 22. The preferred designs of slip segments 18 and co-acting slip wedges 20 will be described in more detail herein.

Located below slip wedge 20 is at least one packer element, and as shown in FIG. 1, a packer element assembly 28 consisting of three expandable elements positioned about mandrel 4. At both ends of packer element assembly 28 are packer shoes 26 which provide axial support to respective ends of packer element assembly 28. Backup rings 24 which reside against respective upper and lower slip wedges 20 provide structural support to packer shoes 26 when the tool is set within a wellbore. The particular packer element arrangement show in FIG. 1 is merely representative as there are several packer element arrangements known and used within the art but.

Located below lower slip wedge 20 are a plurality of multiple slip segments 18 having at least one retaining band 16 secured thereabout as described earlier.

At the lowermost terminating portion of tool 2 referenced as numeral 30 is an angled portion referred to as a mule-shoe which is secured to mandrel 4 by radially oriented pins 32. However lowermost portion 30 need not be a mule shoe but could be any type of section which serves to terminate the structure of the tool or serves to be a connector for connecting the tool with other tools, a valve, or tubing etc. It should be appreciated by those in the art, that pins 8, 14, 16, 22, and 32, if used at all, are preselected to have shear strengths that allow for the tool be set and to be deployed and to withstand the forces expected to be encountered in a wellbore during the operation of the tool.

Referring now to FIGS. 2–3 of the drawings. It is not necessary to have the particular slip segment and slip wedge construction shown in FIGS. 2–4 in order to practice the present invention, as the disclosed slip retention system can be used in connection with any type of downhole tool employing slips that are forced outwardly away from the tool and it does not matter whether or not the tool is made essentially of only metallic components, non-metallic components, or a combination of metallic and non-metallic components.

Figure 2A:
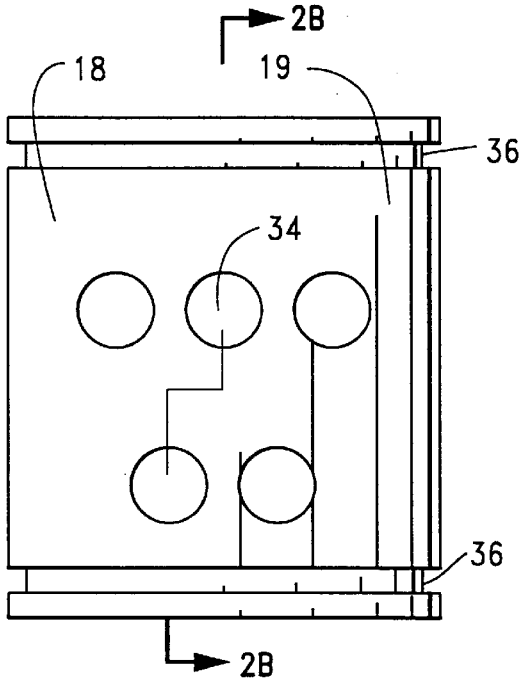
FIG. 2A PRIOR ART
FIG. 2A is a front view of a representative prior art slip segment shown in FIG. 1.

Slip segment 18 as shown in a front view of the slip segment, denoted as FIG. 2A, has an outer external face 19 having a plurality of inserts 34 that have been molded into, or otherwise secured into, face 19. Optional inserts 34 are typically made of zirconia ceramic which have been found to be particularly suitable for a wide variety of applications. Slip segment 18 can be made of a composite material obtained from General Plastics as referenced herein in addition to the materials set forth in the present Assignee's patents referenced herein or it can be cast iron.

Figure 2B:
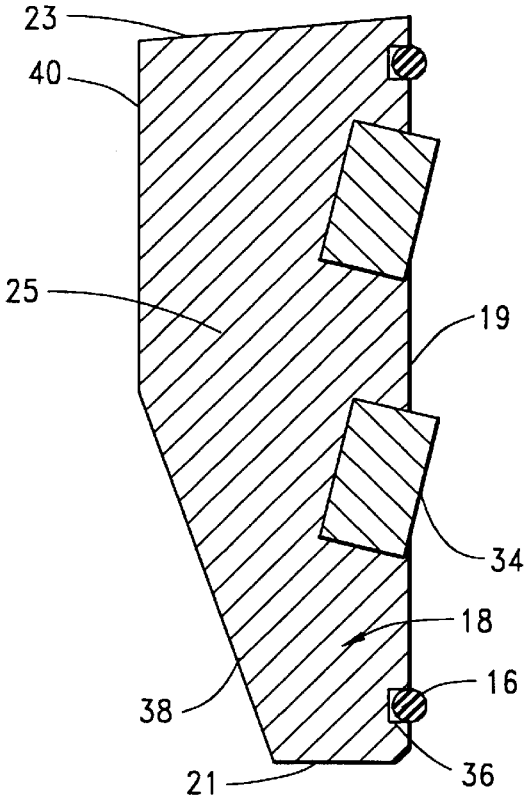
FIG. 2B PRIOR ART
FIG. 2B is a cross-sectional side view of a representative prior art slip segment shown in FIG. 2A.
Figure 2C:
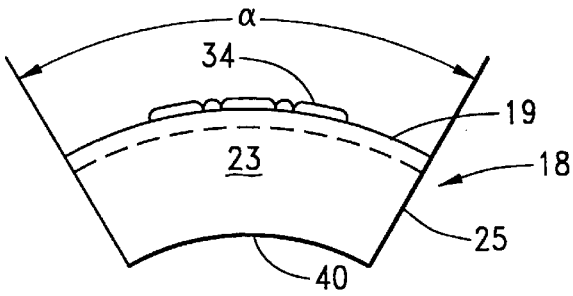
FIG. 2C PRIOR ART
FIG. 2C is a top view of the prior art slip segments shown in FIGS. 2A and 2B.

FIG. 2B is a cross-sectional view taken along line 2B of slip segment of 18 FIG. 2A. Slip segment 18 has two opposing end sections 21 and 23 and has an arcuate inner mandrel surface 40 having topology which is complementary to the outer most surface of mandrel 4. Preferably end section surface 23 is angled approximately 5°, shown in FIG. 2B as angle θ, to facilitate outward movement of the slip when setting the tool. Slip segment bearing surface 38 is flat, or planar, and is specifically designed to have topology matching a complementary surface on slip wedge 20. Such matching complementary bearing surface on slip wedge 20 is designated as numeral 42 and can be viewed in FIG. 3A of the drawings. A top view of slip segment 18, having a flat, but preferably angled, top surface 23 is shown in FIG. 2C. Location and the radial positioning of sides 25 define an angle α which is preselected to achieve an optimal number of segments for a mandrel having an outside diameter of a given size and for the casing or well bore diameter in which the tool is to be set. Angle α is preferably approximately equal to 60°. However, an angle of α ranging from 45° to 60° can be used.

Returning to FIG. 2B, the sides of slip segments 18 are designated by numeral 25. It is preferred that six to eight segments encircle mandrel 4 and be retained in place prior to setting of the tool by at least one, and preferably two slip retaining bands 16 that are accommodated by circumferential grooves 36. Prior art slip retaining bands 16 are made of composite material obtained from General Plastics as referenced herein or other suitable materials such as ANSI 1018 steel wire available from a wide variety of commercial sources.

Figure 3A:
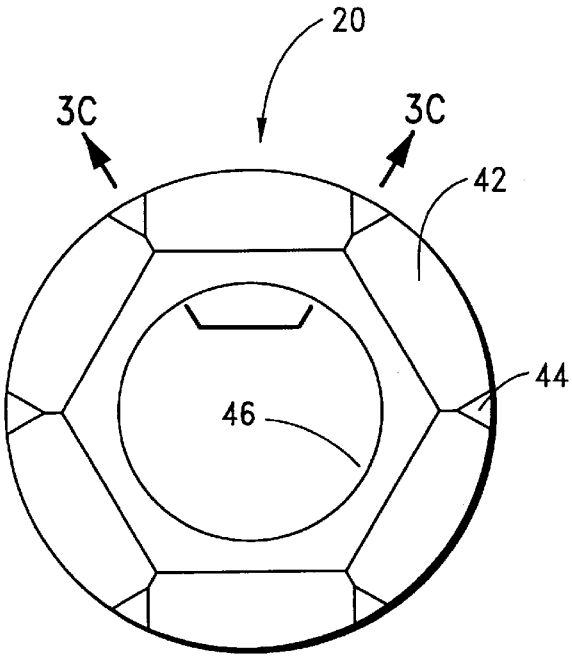
FIG. 3A PRIOR ART
FIG. 3A is top view of a slip wedged typically used with the prior art and with the preferred slip segment of the present invention.
Figure 3B:
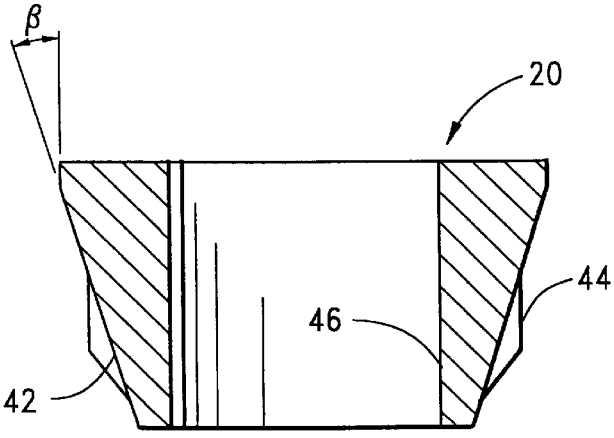
FIG. 3B PRIOR ART
FIG. 3B is a cross-sectional side view of the slip wedge of FIG. 3A.
Figure 3C:
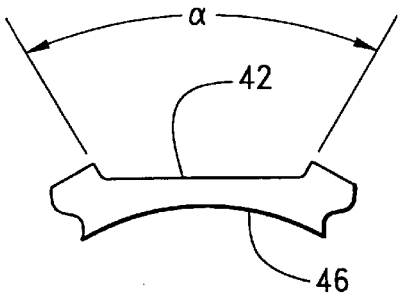
FIG. 3C PRIOR ART
FIG. 3C is an isolated sectional view of one of the multiple planar surfaces of the slip wedge taken along line 3C as shown in FIG. 3A.

Referring to FIG. 3A, a top view is provided of preferred slip wedge 20 having flat, or planar, surfaces 42 which form an opposing sliding bearing surface to flat bearing surface 38 of respectively positioned slip segments 18. The relationship of such surfaces 38 and 42 as installed initially are best seen in FIG. 2B, FIG. 3C, and FIG. 1. As can be seen in FIG. 3C, which is a broken away sectional view taken along line 3C shown in FIG. 3A. It is preferred that slip wedge bearing surface 42 be defined by guides or barriers 44 to provide a circumferential restraint to slip segments 18 as the segments travel axially along slip wedge 20 and thus radially outwardly toward the casing or well bore during the actual setting of the packer tool. Preferably angle β, as shown in FIG. 3B is approximately 18°. However, other angles ranging from 15° to 20° can be used depending on the frictional resistance between the coacting surfaces 42 and 38 and the forces to be encountered by the slip and slip wedge when set in a well bore. Internal bore 46 is sized and configured to allow positioning and movement along the outer surface of mandrel 4.

It has been found that material such as the composites available from General Plastics are particularly suitable for making a slip wedge 20 from in order to achieve the desired results of providing an easily drillable slip assembly while being able to withstand temperatures and pressures reaching 10,000 psi (700 $Kg/cm^2$) and 425° F. (220° C.). However, any material can be used to form slips adapted to use the present slip retentions system.

A significant advantage of using such co-acting flat or planar bearing surfaces in slip segments 18 and slip wedges 20 is that as the slips and wedges slide against each other, the area of contact is maximized, or optimized, as the slip segments axially traverse the slip wedge thereby minimizing the amount of load induced stresses being experienced in the contact area of the slip/slip wedge interface. That is as the slip axially travels along the slip wedge, there is more and more contact surface area available in which to absorb the transmitted loads. This feature reduces or eliminates the possibility of the slips and wedges binding with each other before the slips have ultimately seated against the casing or wellbore. This arrangement is quite different from slips and slip cones using conical surfaces because when using conical bearing surfaces, the contact area is maximized only at one particular slip to slip-cone position. Again the present invention will work quite well with any multiple slip arrangement made of any suitable material.

Figure 4A:
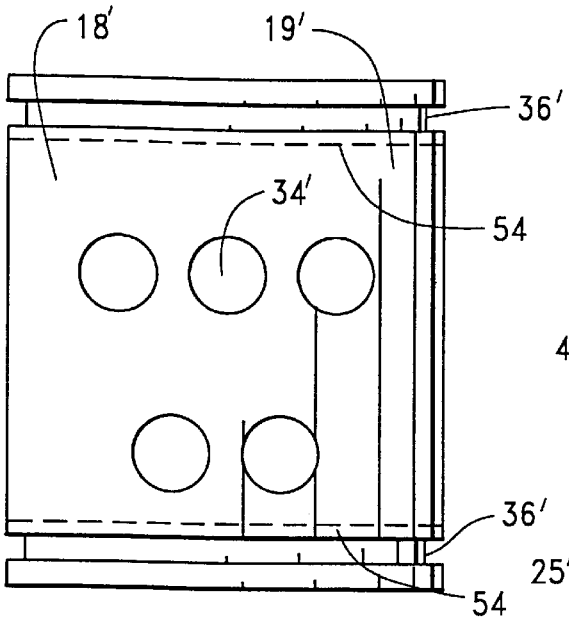
FIG. 4A is a front view of the preferred slip having L-shaped grooves.
Figure 4B:
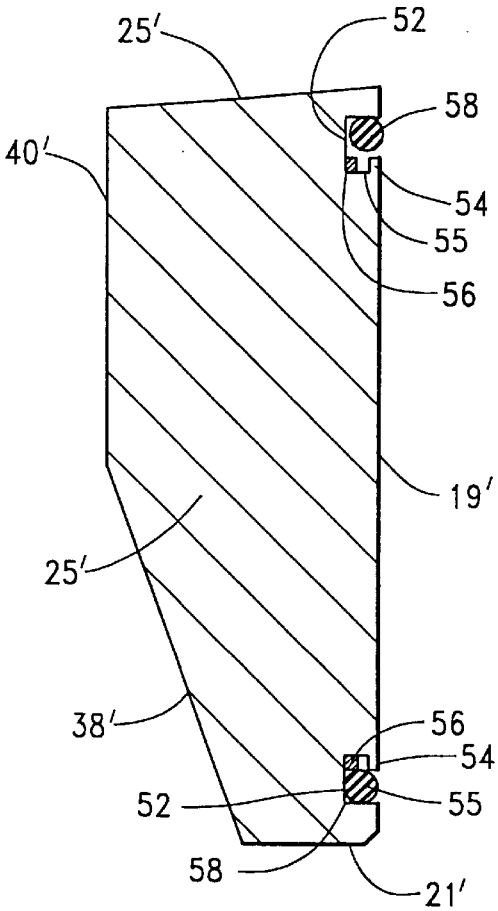
FIG. 4B is a side view of an embodiment of the preferred slip retaining system and further depicts the present retaining system including elastic O-ring members and frangible band members installed in their respective positions within their respective L-shaped grooves.

Referring now to FIG. 4, which depicts a preferred embodiment of the present invention. Slip segment, or slip, 25' has the same general layout as the above discussed prior art slip 25, including outer face 19', end faces 21' and 23', mandrel surface 40', slip bearing surface 38'. Optional inserts 34' are shown in FIG. 4A but are not shown in FIG. 4B. It is contemplated that such inserts would be installed in slip 25' to provide the benefits of using such inserts to better engage the wellbore therewith.

Note that L-shaped groove 52 differs from prior art groove 36 in that L-shaped groove 52, of a preselected size, is provided with an undercut region 55 that preferably forms a protective lip 54.

Preferably, a composite frangible retaining band 56 having a preselected cross section such as a square cross section and being sized to break at a predetermined load, is first installed within undercut region 55 behind protective lip 54. Such retaining members, or bands, can be obtained from General Plastics, 5727 Ledbetter, Houston, Tx. 77087-4095. Cross-sectional profiles other than square or rectangular shapes can be used, however square or rectangular are preferred for ease of manufacture and retention characteristics. After installing band 56, an elastic nitrile rubber O-ring 58 having a durometer hardness of 90 is next installed within groove 54. As can be seen in FIG. 4A, O-ring 58 and groove 56 is sized to be accommodated by groove 54 in such a manner that O-ring 54 does not extend beyond outer face 19', and further constrains frangible retaining band member 56 within undercut region 55 and behind lip 54. Elastic member 58 need not have a circular cross-sectional profile, but such elastic members are readily available from a multitude of commercial vendors. By O-ring 58 not extending beyond face 19', O-ring 58 will not be subjected to objects or irregularities in the wellbore snagging, pulling, or otherwise damaging O-ring 58 during surface handling and downhole placement of the downhole tool in which the slip retaining system is installed. Additionally, by sizing the depth of L-shaped groove 52 and O-ring 58 so that O-ring 58 does not extend past outer face 19', the possibility of O-ring 58 being forced out of groove 52 by any fluid flowing around the packer tool as it is in the wellbore is essentially, if not completely eliminated. Thus, it is recommended that O-ring 58, or equivalent member, not be so positioned where it could be subjected unnecessarily to fluid flow induced forces within the wellbore that could damage or remove the member. By constraining frangible band member 56 behind lip 54 with elastic member 58 as taught herein, upon band 56 breaking in several places about its original circumference, the elastic member serves to somewhat restrain slips 25' in a position about slip wedge 20 while allowing slips 25' to be free enough to seek their proper set position against the wellbore. This provides an additional advantage over prior art retaining bands or wires, in that once the prior art bands were broken the slips were free to fall randomly. This could be a problem when using packer tools that are nominally much smaller than the wellbore that the packer tool is to be placed within. Thus the present invention provides a means for providing a flexible retention of the slips until the slips have reached their final position against the wellbore.

Figure 5:
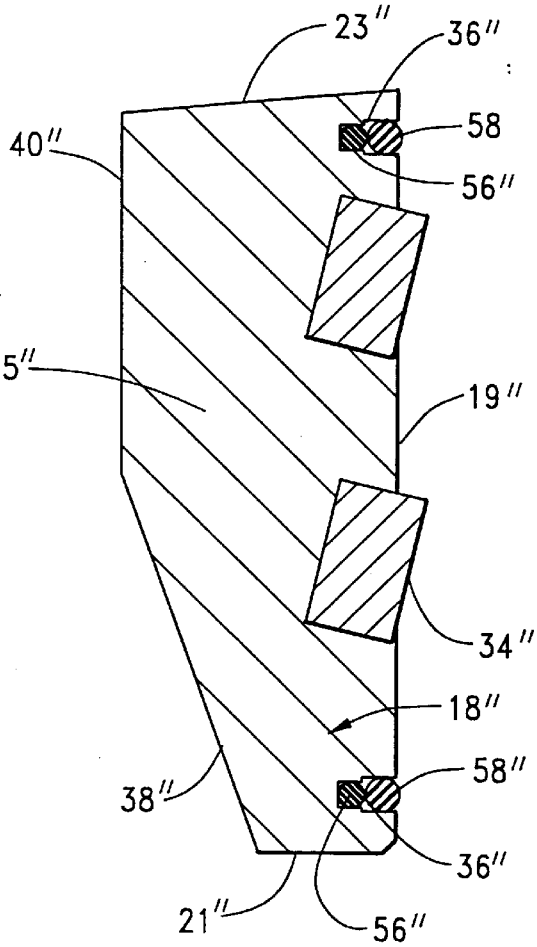
FIG. 5 is a side view of an alternative embodiment of the present invention having a rectangular groove and an elastic O-ring member positioned on-top of a frangible retaining band.

An alternative embodiment of the present retaining system is shown in FIG. 5, a rectangular shaped groove 36" dimensioned and configured to accommodate first a frangible retaining band 56" and then second an elastic O-ring 58" positioned on top of retaining band 56". The lack of a L-shaped groove does not offer the same protection of the retaining band nor does it offer the same amount of freedom for the retaining band to move about within the confines of the elastic band and the back of the groove as does the preferred embodiment. Again it is preferred that the O-ring be flush with face 19" to prevent snagging or undue exposure to fluidic forces. The other features of the depicted slip segment are the same as those discussed previously and are appropriately labeled with a double prime mark.

The alternative embodiment offers many of the other benefits of the preferred embodiment such as the constrainment of the retaining band upon it ultimately being broken while allowing a more simple to construct groove. In a yet further alternative embodiment the frangible retaining band of the present invention could be eliminated entirely and a stronger elastic O-ring, or other elastic member, be set in a groove to retain the slips until the tool is subjected to enough of a force, or load, to set the tool. Such a embodiment does not offer the redundancy of having a separate elastic member and a separate frangible member and care would have to be exercised not to provide a single elastic member that was so strong that the slips could not fully and properly be forced outwardly toward the wellbore upon being set.

A composite packer having a nominal seven (7) inch (17.8 cm) diameter was constructed to have two sets of slips of eight slips per set about the tool. Each slip had an upper L-groove and lower L-groove as shown in FIGS. 4A and 4B. The L-groove was 0.140 inches (3.56 mm) deep, 0.210 inches (5.33 mm) tall at the back of the groove, 0.155 inches (3.94 mm) at the front thereby providing a lip of 0.055 inches (1.4 mm), or in other words an undercut of 0.055 (1.4 mm) inches. A nitrile O-ring #248 having a durometer hardness 90 was used to restrain a composite retaining band having a square cross section measuring 0.050 inches (1.27 mm) per side in one groove and a like O-ring was used to retain a fiberglass composite retaining band having a rectangular cross section measuring 0.070 inches (1.78 mm) in height and 0.065 (1.65 mm)inches in width. Both retaining bands were obtained from General Plastics company. The retaining bands were cut from fiberglass-reinforced thin walled composite tube wrapped with a 1543 E-glass industrial fabric containing approximately 86% fiber by volume in wrap direction with generally available resins. The 1543 E-Glass fabric is available from Hexcel Corporation in California as well as others. Proper layup and using care in maintaining tube dimensions provided a stable retaining band tensile strength. The retaining bands were made of differing sizes in order to cause the larger band placed opposite bearing surface 38' to break at approximately the same tool load as the smaller band placed opposite mandrel surface 40'. This is based upon the differing interaction of the slips and the wedge surfaces as the slips are being forced outwardly by the wedge bearing surfaces as the tool is being set. Having differing cross sectional areas of the same retaining band material is not necessary but provides a more consistent setting of the packer tool. Of course, one could use a plurality of same sized retaining bands, and merely change the tensile strength characteristics appropriately. Furthermore merely one frangible retaining band and one elastic member per set of slips could also be used if desired.

The practical operation of downhole tools embodying the present invention, including the representative tool depicted and described herein, is conventional and thus known in the art as evidenced by prior documents.

Furthermore, although the disclosed invention has been shown and described in detail with respect to the preferred embodiment, it will be understood by those skilled in the art that various changes in the form and detail thereof may be made without departing from the spirit and scope of this invention as claimed.

What is claimed is:

1. A downhole tool apparatus for use in a wellbore comprising:

a) a mandrel;

b) a slip means disposed on the mandrel for grippingly engaging the wellbore when set into position;

c) at least one packer element to be axially retained about the mandrel and located at a preselected position along the mandrel defining a packer element assembly;

d) the slip means having a plurality of slip segments that are to be retained in a pre-set position, at least one of the slip segments having at least one groove located in an outer face of the slip segment;

e) a frangible retaining member installed in the at least one groove and extending about the slip segments; and f) an elastic member installed in the at least one groove and extending about the slip segments to provide a means for initially retaining the slip segments about the mandrel.

2. The apparatus of claim 1 wherein at least a portion of the downhole tool is made of a non-metallic material.

3. The apparatus of claim 1 wherein at least one of the slip segments is made of a laminated non-metallic composite material.

4. The apparatus of claim 2 wherein the frangible retaining member is a band made essentially of a laminated non-metallic composite material.

5. The apparatus of claim 1 wherein the slip segments have at least one L-shaped groove in the outer surface of each slip segment thereby providing a lip partially covering the grooves.

6. The apparatus of claim 5 wherein a frangible retaining member is positioned under the lip of each of the at least one L-shaped grooves located in the slip segments and an elastic member is placed in the remainder of the grooves to further constrain excessive movement of the frangible retaining member.

7. The apparatus of claim 6 wherein the elastic member is a nitrile rubber O-ring of a preselected configuration, size, and hardness.

8. The apparatus of claim 6 wherein the frangible retaining member is a composite band comprising glass fabric and resins and is constructed to part at approximately a predetermined tensile load.

9. The apparatus of claim 6 wherein the slip segments have at least two such grooves, each groove having a respective retaining member and a respective elastic member, and wherein the retaining members have differing tensile failure loads.

10. The apparatus of claim 9 wherein the retaining members are composite bands comprising glass fabric and resins and the elastic members are nitrile rubber O-rings having a durometer hardness of 90.

11. A method of retaining at least one set of a plurality of slip segments about a downhole tool apparatus having a mandrel comprising:

a) providing each slip with at least one groove on an outer face thereof;

b) installing a frangible retaining member in the at least one groove located within the slip segments; and c) installing an elastic member proximate to the retaining member in the at least one groove located within the slip segments.

12. The method of claim 11 wherein at least one of the grooves is under cut to provide a L-shaped groove so as to form a lip over a portion of the groove.

13. The method of claim 11 wherein the provided retaining member is a composite of fiberglass and resins.

14. The method of claim 11 wherein the provided elastic member is a rubber O-ring of a preselected size, configuration, and hardness.

15. The method of claim 12 wherein two such L-shaped grooves are provided and each such groove has a respective frangible composite retaining member and a respective elastic member.

16. The method of claim 15 wherein the retaining member is first installed and positioned under the lip of the L-groove, and the elastic member is installed next to the retaining member in such a manner that the elastic member is at least flush with the outer surface of the slip segment.

17. An improved method for retaining a plurality of slip segments about a downhole tool having a mandrel and a slip wedge for forcing the slip segments outwardly upon the tool being subjected to a predetermined load, the improvement comprising:

a) providing a first groove and a second groove in the outer surface of the slip segments;

b) undercutting the two grooves to form a lip over the undercut portion of each of the grooves;

c) installing a first frangible retaining member having a four-sided cross-section in the undercut below the lip in the first groove;

d) installing a first elastic O-ring member in the portion of the groove that is not undercut in the first groove;

e) installing a second frangible retaining member having a four-sided cross-section in the undercut below the lip in the second groove; and f) installing a second elastic O-ring member in the portion of the groove that is not undercut in the second groove.

18. The method of claim 17 further comprising: constructing the first frangible retaining member to have a tensile failure load that differs from the tensile failure load of the second frangible retaining member to offset load variances due to the slips being forced outwardly by the slip wedge.

19. The method of claim 18 wherein at least one frangible retaining band is constructed of E-glass and resin composite.

20. The method of claim 18 wherein at least one elastic O-ring member is constructed of nitrile rubber of a preseleted hardness.

* * * * *